US010224666B2

(12) United States Patent
Aoshima

(10) Patent No.: US 10,224,666 B2
(45) Date of Patent: Mar. 5, 2019

(54) PACKING AND SHIELD CONNECTOR

(71) Applicant: Yazaki Corporation, Tokyo (JP)

(72) Inventor: Kengo Aoshima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/703,570

(22) Filed: Sep. 13, 2017

(65) Prior Publication Data

US 2018/0076561 A1 Mar. 15, 2018

(30) Foreign Application Priority Data

Sep. 15, 2016 (JP) ..... 2016-180239

(51) Int. Cl.
*H01R 13/40* (2006.01)
*H01R 13/52* (2006.01)
(Continued)

(52) U.S. Cl.
CPC ..... *H01R 13/5202* (2013.01); *H01R 13/40* (2013.01); *H01R 13/648* (2013.01); *H01R 13/6585* (2013.01)

(58) Field of Classification Search
CPC ..... H01R 13/40; H01R 13/5202; H01R 13/5205; H01R 13/648; H01R 13/6581; H01R 13/5219
(Continued)

(56) References Cited

U.S. PATENT DOCUMENTS 4,676,575 A * 6/1987 Denlinger ..... H01B 17/308 439/271
6,129,585 A 10/2000 Hashizawa et al.
(Continued)

FOREIGN PATENT DOCUMENTS

CN 1652412 A 8/2005
CN 102754284 A 10/2012
(Continued)

OTHER PUBLICATIONS

French Office Action for the related French Patent Application No. 17 58483 dated Jan. 16, 2018.
(Continued)

*Primary Examiner* — Edwin A. Leon
*Assistant Examiner* — Oscar C Jimenez
(74) *Attorney, Agent, or Firm* — Kenealy Vaidya LLP

(57) ABSTRACT

A shield connector has a packing. The packing has a plurality of tubular packing bodies that respectively mates with a plurality of tubular portions that respectively accommodating one or more electric wires connected to terminals in a connector housing, and have inner circumferential surfaces making contact with the tubular portions, and a connecting portion that connects the neighboring packing bodies. Each packing body has a first seal surface connected to an outer circumferential surface of the connecting portion in a connector insertion direction side out of an outer circumferential surface, and a second seal surface formed to extend in a circumferential direction and provided in a connector removal direction side. The first seal surface makes contact with the casing. Each second seal surface makes contact with each of a plurality of shield shells.

4 Claims, 3 Drawing Sheets

(51) Int. Cl.
*H01R 13/648* (2006.01)
*H01R 13/6585* (2011.01)

(58) Field of Classification Search
USPC ..... 439/587–589
See application file for complete search history.

(56) References Cited

U.S. PATENT DOCUMENTS 6,953,357 B2 * 10/2005 Fukushima ..... H01R 13/5219 439/271
2002/0155756 A1 * 10/2002 Yoshioka ..... H01R 13/648 439/607.01
2005/0176295 A1 8/2005 Morita et al.
2008/0026639 A1 * 1/2008 Sardi ..... B60L 11/1818 439/607.41
2011/0230086 A1 * 9/2011 Fujiwara ..... H01R 13/5202 439/559
2013/0088106 A1 * 4/2013 Bitzer ..... H01R 13/5202 310/71
2013/0130530 A1 * 5/2013 Casses ..... H01R 13/5219 439/271
2015/0180156 A1 * 6/2015 Endo ..... H01R 13/60 439/571
2015/0180157 A1 * 6/2015 Endo ..... H01R 13/60 439/571
2015/0180159 A1 * 6/2015 Endo ..... H01R 13/60 439/587
2015/0207263 A1 * 7/2015 Fabre ..... H01R 13/506 439/271
2016/0056590 A1 2/2016 Sugiyama et al.
2016/0156124 A1 6/2016 Hashimoto

FOREIGN PATENT DOCUMENTS

CN 105164869 A 12/2015
CN 105655798 A 6/2016
JP 2002-313453 A 10/2002
JP 3595132 B2 12/2004
JP 2013-516032 A 5/2013
JP 2016-127675 A 7/2016

OTHER PUBLICATIONS

Japanese Office Action for the related Japanese Patent Application No. 2016-180239 dated Aug. 7, 2018.
Chinese Office Action for the related Chinese Patent Application No. 2017108277727.0 dated Nov. 30, 2018.

* cited by examiner

PACKING AND SHIELD CONNECTOR

CROSS-REFERENCE TO RELATED APPLICATION(S)

The present application claims priority to and incorporates by reference the entire contents of Japanese Patent Application No. 2016-180239 filed in Japan on Sep. 15, 2016.

BACKGROUND OF THE INVENTION

1. Field of the Invention

The present invention relates to a packing and a shield connector.

2. Description of the Related Art

In the related art, there is disclosed a shield connector that electrically connects a shield shell housed in a connector housing and a casing of an electric apparatus to each other to perform grounding (earth) by installing the connector housing in the conductive casing of the electric apparatus (for example, see Japanese Patent No. 3595132).

However, some of the shield connectors described above have a packing for preventing intrusion of liquid from a gap between the casing and the connector housing and intrusion of liquid from a gap between the connector housing and the shield shell.

The aforementioned packing is provided in the shield shell as many as the number of poles of terminals of the shield connector. For this reason, the casing is necessarily provided with waterproof slots as many as the number of poles of terminals of the shield connector. Fabrication of a plurality of waterproof slots necessitates man hours.

SUMMARY OF THE INVENTION

In view of the aforementioned problems, the present invention is to provide a packing and a shield connector capable of simplifying fabrication of waterproof slots of a casing.

In order to solve the above mentioned problem and achieve the object, a packing according to one aspect of the present invention, the packing having elasticity and partially interposed between a connector housing and a conductive casing while the connector housing has an insertion state into a connector through-hole formed in the casing, the packing includes a plurality of tubular packing bodies that respectively mates with a plurality of tubular portions respectively accommodating one or more electric wires connected to terminals in the connector housing, and have inner circumferential surfaces making contact with the tubular portions; and a connecting portion that connects the neighboring packing bodies, wherein a first seal surface connected to an outer circumferential surface of the connecting portion is provided in a connector insertion direction side out of an outer circumferential surface of each of the packing bodies, a second seal surface extending in a circumferential direction is formed in a connector removal direction side opposite to the connector insertion direction out of the outer circumferential surface of each of the packing bodies, the first seal surface makes contact with the casing, the second seal surface has an end of the connector insertion direction making contact with the casing and a portion buried in the connector housing, and the second seal surface makes contact with each of a plurality of shield shells that encapsulate each electric wire accommodated in each of the tubular portions.

According to another aspect of the present invention, in the packing, it is preferable that the connecting portion has a cavity, and the cavity is blocked by an insertion member other than the packing.

According to still another aspect of the present invention, in the packing, it is preferable that the connecting portion has at least an opening formed in the connector removal direction, and a cavity is provided to have a portion inserted into the connector housing from the opening in the insertion state.

In order to achieve the object, a shield connector according to still another aspect of the present invention includes two or more electric wires each of which is connected to a terminal; a connector housing provided with at least one or more tubular portions respectively mating with the electric wires to accommodate and hold each of the electric wires; and a plurality of shield shells each of which has an end of a connector insertion direction making contact with a conductive casing and a portion buried in the connector housing, each of the shield shells encapsulating each of the electric wires; and an elastic packing, wherein the packing is partially interposed between the connector housing and the casing while the connector housing has an insertion state into a connector through-hole formed in the casing, the packing has a plurality of tubular packing bodies that respectively mates with the plurality of tubular portions and have inner circumferential surfaces making contact with the tubular portions, and a connecting portion that connects the neighboring packing bodies, a first seal surface connected to an outer circumferential surface of the connecting portion is provided in a connector insertion direction side out of an outer circumferential surface of each of the packing bodies, a second seal surface extending in a circumferential direction is formed in a connector removal direction side opposite to the connector insertion direction out of the outer circumferential surface of each of the packing bodies, the first seal surface makes contact with the casing, and each of the second seal surfaces makes contact with each of the shield shell.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A packing and a shield connector according to embodiments of the present invention will now be described in details with reference to the accompanying drawings. Note that the present invention is not limited by the embodiments described below. In additions, elements described in the following embodiments include those that can be easily substituted by a so-called person ordinarily skilled in the art, or their substantial equivalents. Furthermore, the elements described in the following embodiments may include various omissions, substitutions, and modifications without departing from the spirit and scope of the invention.

EMBODIMENTS

Figure 1:
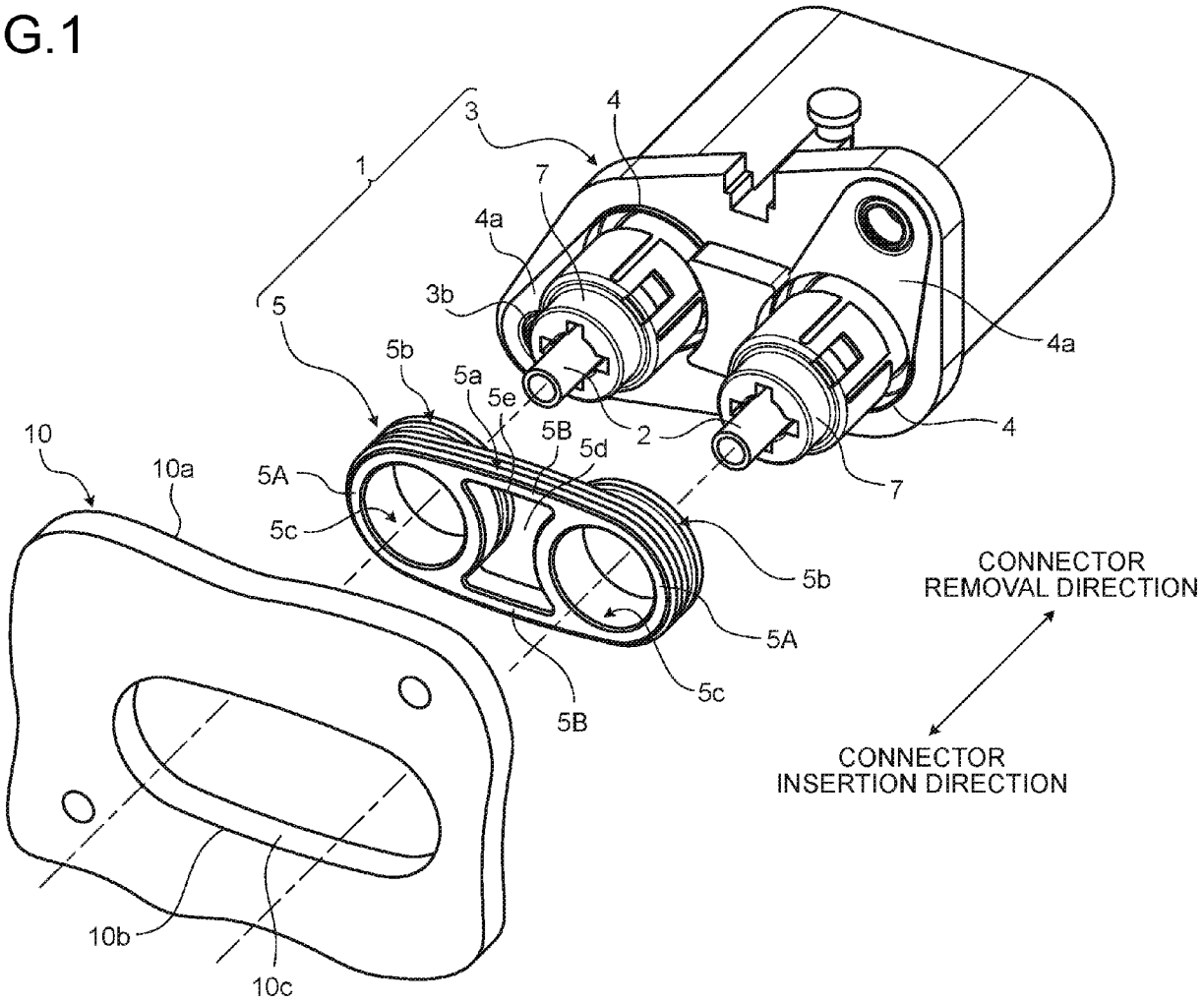
FIG. 1 is an exploded perspective view illustrating a schematic configuration of a shield connector according to an embodiment.
Figure 2:
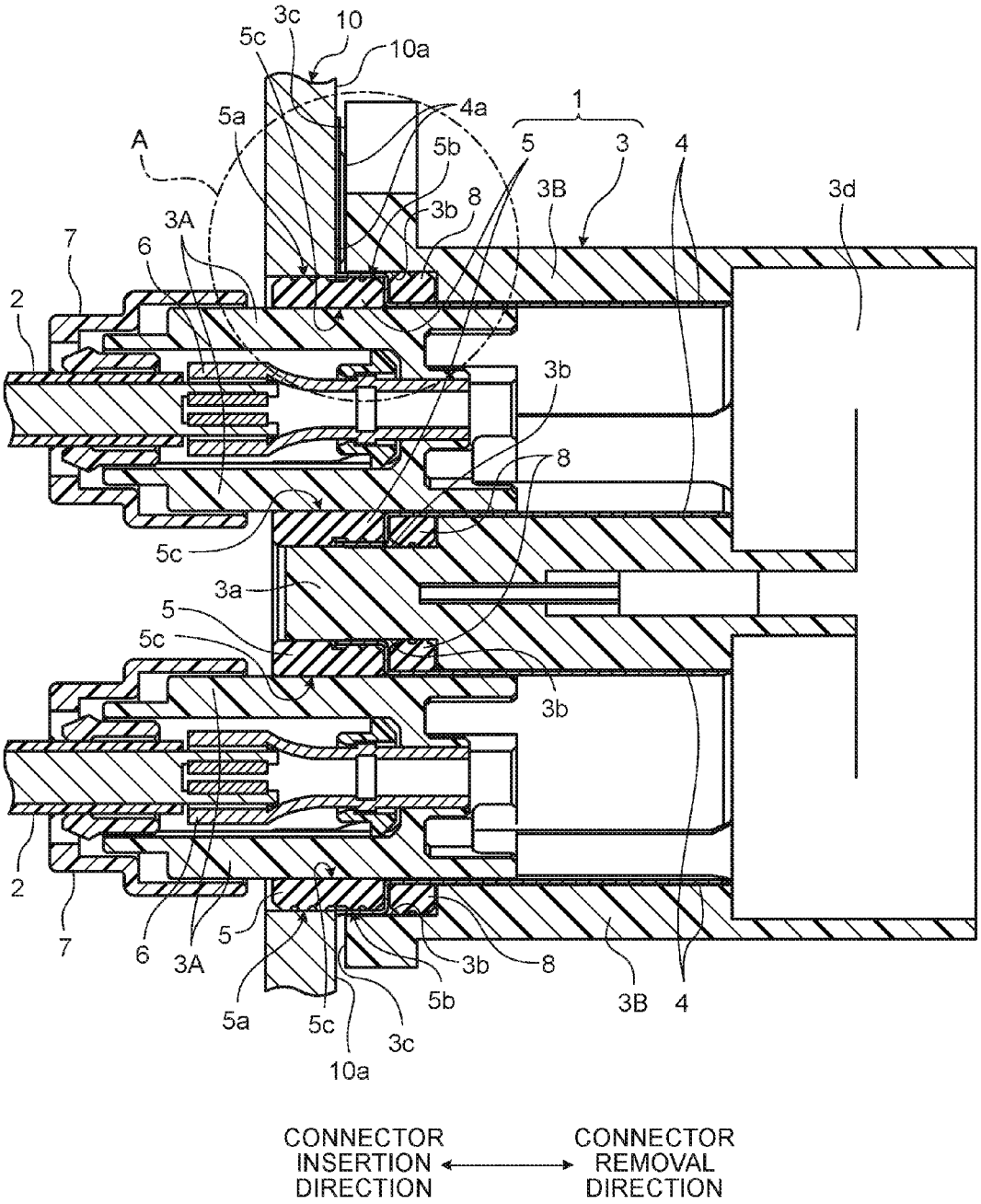
FIG. 2 is a cross-sectional view illustrating a schematic configuration of the shield connector according to the embodiment.
Figure 3:
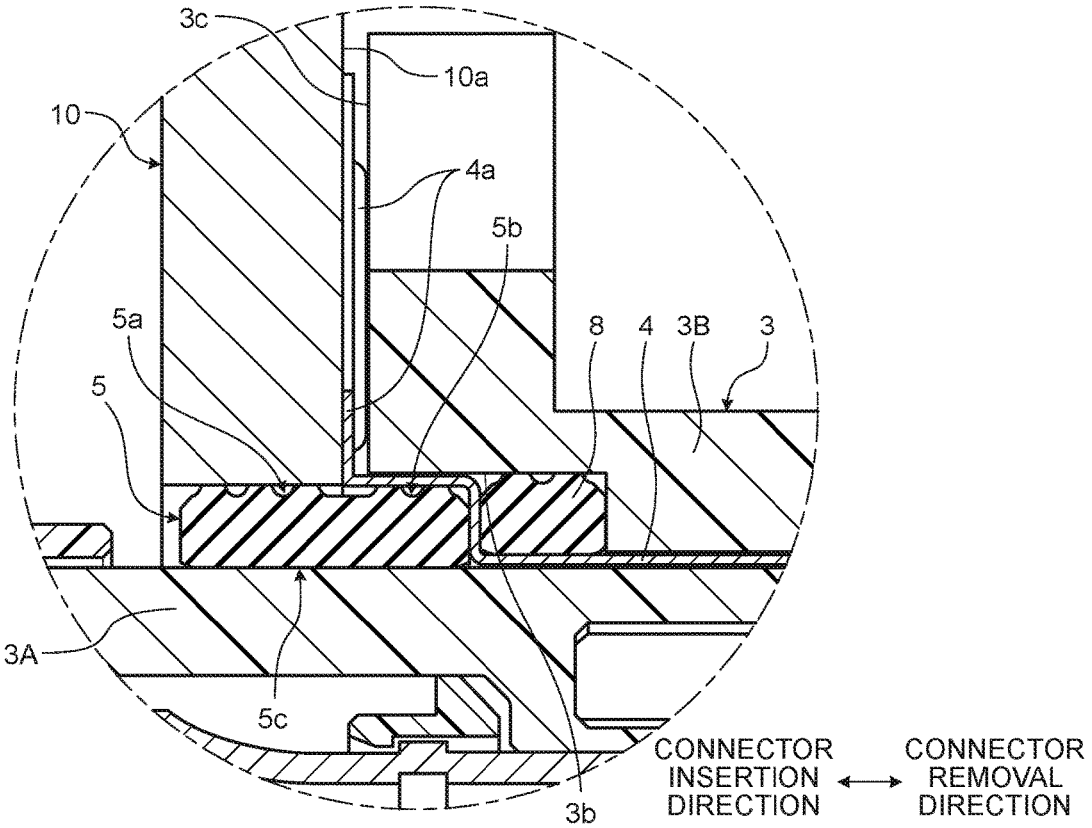
FIG. 3 is an enlarged view illustrating a portion A of FIG. 2.
Figure 4:
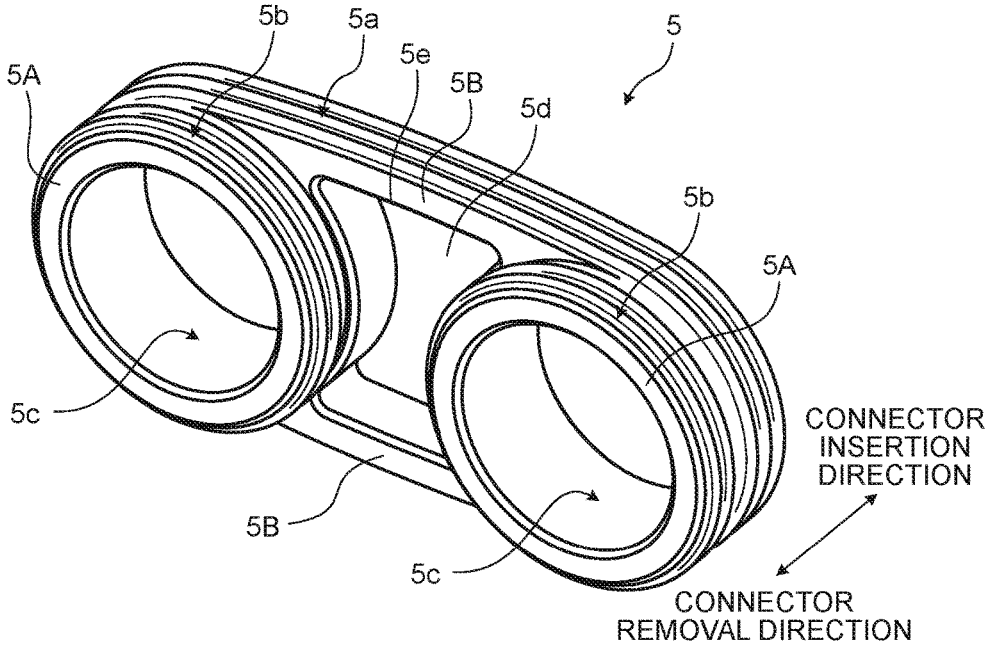
FIG. 4 is a perspective view illustrating a schematic configuration of a packing according to an embodiment.

A packing and a shield connector according to this embodiment will be described with reference to FIGS. 1 to 4. FIG. 1 is an exploded perspective view illustrating a schematic configuration of a shield connector according to an embodiment. FIG. 2 is a cross-sectional view illustrating a schematic configuration of the shield connector according to the embodiment. FIG. 3 is an enlarged view illustrating a portion A of FIG. 2. FIG. 4 is a perspective view illustrating a schematic configuration of a packing according to an embodiment. Note that FIG. 1 illustrates a state in which a rear holder is installed in a pair of tubular portions of a connector housing.

A shield connector 1 illustrated in FIGS. 1 and 2 is a shielded connector mounted on a vehicle such as an electric vehicle (EV), a hybrid electric vehicle (HEV), and a plug-in hybrid electric vehicle (PHEV) to supply electric power to an inverter, a motor, or the like and supply electric signals to various electronic units. The shield connector 1 according to this embodiment includes at least two terminals serving as an electric connector and prevents radiation of electric noise to the outside by covering the terminal and a part of an electric wire connected to this terminal. This shield connector 1 is a female connector fitted to a counter part of a pair of male and female connectors, that is, a male connector (not illustrated) to house a female terminal conductively connected to the male terminal housed in this male connector. The shield connector 1 is installed in a casing 10 of an electronic unit such as an inverter or a motor while interposing a packing 5.

Note that, in the following description, the shield connector 1 has a removal direction opposite to an insertion direction of the connector. Here, the insertion direction of the connector against the shield connector 1 will be referred to as a "connector insertion direction," and the removal direction of the connector against the shield connector 1 will be referred to as a "connector removal direction." In addition, unless such both directions are specified, those will be referred to as a "connector insertion/removal direction."

Specifically, as illustrated in FIGS. 1 and 2, the shield connector 1 includes two electric wires 2, a connector housing 3, a pair of shield shells 4, and a packing 5.

The electric wire 2 includes a conductive core wire formed by a plurality of strands (not illustrated) and an insulating cladding portion that covers an outer circumference side of the core wire. A female terminal (hereinafter, simply referred to as a "terminal") 6 electrically connected to a male terminal (not illustrated) which is a male connector side is crimped to a tip of the electric wire 2. The terminal 6 is formed of conductive metal and the like. According to this embodiment, a part of the two electric wires 2 is accommodated in a connector housing 3 as an element of the shield connector 1.

The connector housing 3 is formed of insulating synthetic resin or the like. The connector housing 3 according to this embodiment houses and holds the shield shell 4 and a part of the two electric wires 2 each of which is connected to the terminal 6. Specifically, the connector housing 3 includes a pair of tubular portions 3A and a housing body 3B. Each tubular portion 3A extends from the housing body 3B in the connector insertion direction and accommodates a part of the electric wire 2 connected to the terminal 6. As illustrated in FIG. 2, the housing body 3B houses two shield shells 4. The housing body 3B includes a protrusion 3*a*, an inner circumferential surface 3*b*, a casing installation surface 3*c*, and a connector insertion cavity 3*d*. The protrusion 3*a* is a portion protruding in the connector insertion direction between a pair of tubular portions 3A. That is, the protrusion 3*a* is a portion inserted into the packing 5 as a part of the connector housing 3 in an insertion state of the connector housing 3. The insertion state of the connector housing 3 herein refers to a state in which the shield connector 1 is installed in a casing 10 described below. More specifically, this means a state in which the tubular portion 3A of the connector housing 3 is inserted into a connector through-hole 10*b* formed in the casing 10. The inner circumferential surface 3*b* is a portion formed in a circumferential direction and in a position facing an outer circumferential surface of an end of the connector removal direction of the tubular portion 3A, in the housing body 3B. The inner circumferential surface 3*b* partially makes contact with the outer circumferential surface of the shield shell 4. The casing installation surface 3*c* is a portion installed in the casing 10 in the insertion state of the connector housing 3. The connector insertion cavity 3*d* is a portion where the male connector (not illustrated) is inserted. A rear holder 7 where the electric wire 2 is inserted is fitted to an end of the connector insertion direction of the tubular portion 3A. The rear holder 7 is an electric wire holding member formed of insulating synthetic resin to hold each electric wire 2 while they are inserted. The rear holder 7 is locked to the outer circumferential surface of the tubular portion 3A.

The shield shell 4 is formed of conductive metal or the like and is molded in a tubular shape. The shield shell 4 is housed in the connector housing 3 as many as the number of poles, that is, the number of terminals. That is, in this embodiment, two shield shells 4 are housed in the housing body 3B. Each shield shell 4 is arranged in the connector insertion/removal direction to accommodate a part of the electric wire 2 connected to the terminal 6. The shield shell 4 has a contact 4*a* extending perpendicularly to the connector insertion/removal direction from an end of the connector insertion direction of the shield shell 4. The contact 4*a* is nipped between a connector installation surface 10*a* of the casing 10 and the casing installation surface 3*c* of the connector housing 3 in the insertion state of the connector housing 3.

The packing 5 is a waterproofing member capable of preventing intrusion of liquid into the insides of the casing 10 and the connector housing 3 from a gap between the casing 10 and the connector housing 3 in the insertion state of the connector housing 3. That is, the packing 5 is partially interposed between the connector housing 3 and the casing 10 while it is inserted into the connector through-hole 10*b* formed in the casing 10. The packing 5 is formed of elastic synthetic resin or the like. The packing 5 is formed of, for example, various synthetic rubber such as silicon rubber, acrylic rubber, and fluorine rubber. As illustrated in FIG. 4, the packing 5 includes a pair of packing bodies 5A and a connecting portion 5B that connects the pair of neighboring packing bodies 5A. Each packing bodies 5A mates with each tubular portion 3A of the connector housing 3 and has a tubular shape such that an inner circumferential surface 10*c* makes contact with the tubular portion 3A. Each packing body 5A is provided with a first seal surface 5*a* that connects the outer circumferential surface of the connecting portion 5B to the connector insertion direction side out of the outer circumferential surface. The first seal surface 5*a* is a part making contact with the casing 10. That is, the first seal surface 5*a* elastically makes contact with the inner circumferential surface 10*c* of the connector through-hole 10*b* formed in the casing 10 in the insertion state of the connector housing 3. In addition, each packing body 5A is provided with a pair of second seal surfaces 5*b* formed along a circumferential direction in the connector removal direction side of the outer circumferential surface. Each of the second seal surfaces 5*b* makes contact with a pair of shield shells 4. That is, an end of the connector insertion direction of each of the second seal surfaces 5*b* makes contact with the casing 10, and a part thereof is buried in the connector housing 3. In addition, each of the second seal surfaces 5*b* makes contact with each of the pair of shield shells 4 that encapsulates the electric wire 2 accommodated in each tubular portion 3A. The first and second seal surfaces 5*a* and 5*b* are preferably provided with a plurality of ribs as illustrated in FIG. 4. The connecting portion 5B has a cavity 5*d* and an opening 5*e*. The cavity 5*d* is a portion where the protrusion 3*a* as a part of the connector housing 3 is inserted from the opening 5*e* in the insertion state of the connector housing 3. The opening 5*e* is formed in the connector removal direction of the connecting portion 5B and constitutes a part of the cavity 5*d*. According to this embodiment, the shield connector 1 has a tubular auxiliary packing 8 formed of elastic synthetic resin or the like in addition to the packing 5 as illustrated in FIGS. 2 and 3. The auxiliary packing 8 is arranged between the inner circumferential surface 3*b* of the connector housing 3 and the outer circumferential surface of the shield shell 4 in the connector removal direction side from the position of the packing 5 to seal a gap between the connector housing 3 and the shield shell 4.

The casing 10 is a casing included in the electronic unit such as an inverter or a motor. The casing 10 is formed of conductive metal or the like. The casing 10 is electrically connected to the shield shell 4 in the insertion state of the connector housing 3. That is, the shield connector 1 is grounded (earth) as the contact 4*a* of the shield shell 4 is electrically connected to the casing 10 while it is installed in the casing 10. The casing 10 includes a connector installation surface 10*a*, a connector through-hole 10*b*, and an inner circumferential surface 10*c*. The connector installation surface 10*a* is a portion where the casing installation surface 3*c* of the connector housing 3 is adhered by interposing the contact 4*a* of the shield shell 4. The connector through-hole 10*b* is a so-called waterproof slot penetrating the casing 10 in a thickness direction, that is, in the connector insertion/removal direction. According to this embodiment, the connector through-hole 10*b* has an elliptical shape similar to a circumferential shape of the outer circumferential surface of the packing 5. The inner circumferential surface 10*c* is a portion making contact with the second seal surface 5*b* of the outer circumferential surface of the packing 5.

In the shield connector 1 configured as described above, the first seal surface 5*a* formed in the connector insertion direction side out of the outer circumferential surface of the packing 5 elastically makes contact with the inner circumferential surface 10*c* of the connector through-hole 10*b* so as to prevent intrusion of liquid from a gap between the casing 10 and the connector housing 3. Meanwhile, the second seal surface 5*b* formed along a circumferential direction of the connector removal direction side makes contact with the connector housing 3 by interposing the shield shell 4, so as to prevent intrusion of liquid from a gap between the connector housing 3 and the shield shell 4. In this manner, the packing 5 has the first seal surface 5*a* that integrally waterproofs the gap between the casing 10 and the connector housing 3, a plurality of second seal surfaces 5*b* that individually waterproofs gaps between the connector housing 3 and the pair of shield shells 4. Therefore, the two connector through-holes formed in the casing 10 can be integrated into a single hole. As a result, it is possible to simplify fabrication of the waterproof slots for the casing 10 just by forming a single connector through-hole 10*b* as a waterproof slot in the casing 10.

In the packing 5 according to the aforementioned embodiment, an inner circumferential surface 5*c* has a plurality of tubular packing bodies 5A that make contact with the tubular portion 3A of the connector housing 3 and a connecting portion 5B that connects the neighboring packing bodies 5A. Each packing body 5A has a first seal surface 5*a* formed in the connector insertion direction side out of the outer circumferential surface to connect the outer circumferential surface to the outer circumferential surface of the connecting portion 5B and a second seal surface 5*b* formed in the connector removal direction along the circumferential direction. The first seal surface 5*a* makes contact with the casing 10, and each of the second seal surfaces 5*b* makes contact with each of a plurality of shield shells 4. In this configuration, it is possible to integrate two packings provided for each shield shell depending on the number of poles of the terminals in the shield connector 1. Therefore, the two connector through-holes provided in the casing 10 can be integrated into a single hole. As a result, it is possible to simplify fabrication of the waterproof slots for the casing 10 just by forming a single connector through-hole 10*b* as a waterproof slot.

The packing 5 described above is partially interposed between the connector housing 3 inserted into the connector through-hole 10*b* provided in the conductive casing 10 and the casing 10 and has elasticity. In addition, the packing 5 has a plurality of tubular packing bodies 5A that respectively mates with a plurality of tubular portions 3A that accommodate each of one or more electric wires 2 connected to the terminals 6 in the connector housing 3 and have inner circumferential surfaces 5*c* that make contact with the tubular portions 3A, and a connecting portion 5B that connects the neighboring packing bodies 5A. A first seal surface 5*a* connected to the outer circumferential surface of the connecting portion 5B is provided in the connector insertion direction side out of the outer circumferential surface of each packing body 5A. A second seal surface 5*b* extending along the circumferential direction is provided in the connector removal direction side opposite to the connector insertion direction side out of the outer circumferential surface of each packing body 5A. The first seal surface 5*a* makes contact with the casing 10. Each of the second seal surfaces 5*b* has an end of the connector insertion direction that makes contact with the casing 10, and a part thereof is buried in the connector housing 3. In addition, each of the second seal surfaces 5*b* makes contact with each of a plurality of shield shells 4 that encapsulate each electric wire 2 accommodated in each tubular portion 3A.

In the packing 5 having the aforementioned configuration, it is possible to integrate a plurality of packings provided in each of the shield shells as many as the number of poles of terminals of the shield connector 1. Therefore, a plurality of connector through-holes provided in the casing 10 can be integrated into a single hole. As a result, it is possible to integrate the waterproof slots of the casing 10 into a single hole. Accordingly, it is possible to simplify fabrication of the waterproof slots for the casing 10 and reduce the fabrication cost. In addition, since the waterproof slots of the casing 10 can be integrated into a single hole, it is possible to suppress a sealing property of the packing 5 from being degraded by a manufacturing variation in the waterproof slots or the tubular portions 3A that may be generated due to a pair of waterproof slots.

In the packing 5 described above, the connecting portion 5B has at least an opening 5*e* formed in the connector insertion direction and a cavity 5*d* where a part of the connector housing 3 is inserted from the opening 5*e* in the insertion state of the connector housing 3. In this manner, since the connecting portion 5B is provided with the cavity 5*d*, it is possible to maintain the thickness substantially evenly in the circumferential direction from the inner circumferential surface 5*c* of the packing body 5A to the outer circumferential surface. As the connector housing 3 having elasticity different from that of the packing 5 is partially inserted into the cavity 5*d*, it is possible to suppress elastic deformation of the outer circumferential surface of each packing body 5A and thus prevent degradation of the sealing property of the packing 5.

The shield connector 1 described above has two or more electric wires 2 each of which is connected to the terminal 6, a connector housing 3 that accommodates the electric wires 2 in at least one or more tubular portions 3A respectively mating with the electric wires 2 to hold each electric wire 2, a plurality of shield shells 4 having an end of the connector insertion direction making contact with the conductive casing 10 and a portion buried in the connector housing 3 to encapsulate each electric wire 2, and an elastic packing 5. The packing 5 is partially interposed between the connector housing 3 and the casing 10 while the connector housing 3 is inserted into the connector through-hole 10*b* formed in the casing 10. In addition, the packing 5 has a plurality of tubular packing bodies 5A that respectively mates with the tubular portions 3A and have inner circumferential surfaces 5*c* making contact with the tubular portions 3A, and the connecting portion 5B that connects the neighboring packing bodies 5A. The first seal surface 5*a* connected to the outer circumferential surface of the connecting portion 5B is provided in the connector insertion direction side out of the outer circumferential surface of each packing body 5A. The second seal surface 5*b* extending along the circumferential direction is provided in the connector removal direction side opposite to the connector insertion direction out of the outer circumferential surface of each packing body 5A. The first seal surface 5*a* makes contact with the casing 10. Each of the second seal surfaces 5*b* makes contact with the shield shell 4.

In the shield connector 1 having the aforementioned configuration, it is possible to integrate a plurality of packings provided for each shield shell depending on the number of poles of terminals of the shield connector 1 and thus integrate a plurality of connector through-holes formed in the casing 10 into a single hole. As a result, it is possible to integrate the waterproof slots of the casing 10 into a single hole. Therefore, it is possible to simplify fabrication of the waterproof slots for the casing 10 and reduce the fabrication cost. In addition, since the waterproof slots of the casing 10 can be integrated into a single hole, it is possible to prevent degradation of the sealing property of the packing 5 generated by a manufacturing variation in the waterproof slots or the tubular portions 3A that may be caused when two waterproof slots are formed.

Modification

Note that, in the aforementioned description, a part of the connector housing 3, that is, the protrusion 3*a* is inserted into the cavity 5*d*. However, the present invention is not limited thereto. Instead, the cavity 5*d* may be blocked by an insertion member other than the packing 5. If an insertion member formed of a material different from that of the packing 5 is inserted into the cavity 5*d* in this manner, it is possible to suppress elastic deformation of the outer circumferential surface of each packing body 5A and thus prevent degradation of the sealing property of the packing 5. This insertion member is preferably formed of at least a material having elasticity different from that of the packing 5. In addition, although the cavity 5*d* is a through-hole penetrating in the connector insertion/removal direction as illustrated in FIG. 4, the cavity 5*d* may not be a through-hole.

The packing according to the embodiment has a plurality of tubular packing bodies having the inner circumferential surfaces making contact with the tubular portions, and a connecting portion that connects the neighboring packing bodies. Each packing body has a first seal surface connected to an outer circumferential surface of the connecting portion and provided in a connector insertion direction side out of the outer circumferential surface, and a second seal surface formed to extend in a circumferential direction and provided in a connector removal direction side. The first seal surface makes contact with the casing. Each of the second seal surfaces makes contact with each of a plurality of shield shells. As a result, it is possible to integrate a plurality of packings provided for each shield shell depending on the number of poles of terminals of the shield connector and thus integrate a plurality of connector through-holes formed in the casing into a single hole. Consequently, it is possible to simplify fabrication of the waterproof slots for the casing just by forming a single connector through-hole as the waterproof slots in the casing.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A packing having elasticity and partially interposed between a connector housing and a conductive casing while the connector housing has an insertion state into a connector through-hole formed in the casing, the packing comprising:

a plurality of tubular packing bodies that respectively mates with a plurality of tubular portions respectively accommodating one or more electric wires connected to terminals in the connector housing, and have inner circumferential surfaces making contact with the tubular portions; and a connecting portion that connects the neighboring packing bodies, wherein a first seal surface connected to an outer circumferential surface of the connecting portion is provided in a connector insertion direction side out of an outer circumferential surface of each of the packing bodies, a second seal surface extending in a circumferential direction is formed in a connector removal direction side opposite to the connector insertion direction out of the outer circumferential surface of each of the packing bodies, the first seal surface makes contact with the casing, the second seal surface has an end of the connector insertion direction making contact with the casing and a portion buried in the connector housing, and the second seal surface makes contact with each of a plurality of shield shells that encapsulate each electric wire accommodated in each of the tubular portions.

2. The packing according to claim 1, wherein the connecting portion has a cavity, and the cavity is blocked by an insertion member other than the packing.

3. The packing according to claim 1, wherein the connecting portion has at least an opening formed in the connector removal direction, and a cavity is provided to have a portion inserted into the connector housing from the opening in the insertion state.

4. A shield connector comprising:

two or more electric wires each of which is connected to a terminal;

a connector housing provided with at least one or more tubular portions respectively mating with the electric wires to accommodate and hold each of the electric wires; and a plurality of shield shells each of which has an end of a connector insertion direction making contact with a conductive casing and a portion buried in the connector housing, each of the shield shells encapsulating each of the electric wires; and an elastic packing, wherein the packing is partially interposed between the connector housing and the casing while the connector housing has an insertion state into a connector through-hole formed in the casing, the packing has a plurality of tubular packing bodies that respectively mates with the plurality of tubular portions and have inner circumferential surfaces making contact with the tubular portions, and a connecting portion that connects the neighboring packing bodies, a first seal surface connected to an outer circumferential surface of the connecting portion is provided in a connector insertion direction side out of an outer circumferential surface of each of the packing bodies, a second seal surface extending in a circumferential direction is formed in a connector removal direction side opposite to the connector insertion direction out of the outer circumferential surface of each of the packing bodies, the first seal surface makes contact with the casing, and each of the second seal surfaces makes contact with the casing and each of the second seal surfaces makes contact with each of the shield shells at the portion buried in the connector housing.

* * * * *